US011348779B2

(12) United States Patent
Nishiguchi

(10) Patent No.: US 11,348,779 B2
(45) Date of Patent: May 31, 2022

(54) ION DETECTION DEVICE AND MASS SPECTROMETER

(71) Applicant: SHIMADZU CORPORATION, Kyoto (JP)

(72) Inventor: Masaru Nishiguchi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 469 days.

(21) Appl. No.: 16/491,448

(22) PCT Filed: May 17, 2017

(86) PCT No.: PCT/JP2017/018454
§ 371 (c)(1),
(2) Date: Sep. 5, 2019

(87) PCT Pub. No.: WO2018/211611
PCT Pub. Date: Nov. 22, 2018

(65) Prior Publication Data
US 2020/0035474 A1 Jan. 30, 2020

(51) Int. Cl.
*H01J 49/02* (2006.01)
*H01J 49/42* (2006.01)
*H01J 49/06* (2006.01)

(52) U.S. Cl.
CPC ..... *H01J 49/025* (2013.01); *H01J 49/4215* (2013.01); *H01J 49/061* (2013.01)

(58) Field of Classification Search
CPC ..... H01J 49/025; H01J 49/4215; H01J 49/061
See application file for complete search history.

(56) References Cited

U.S. PATENT DOCUMENTS 4,808,818 A * 2/1989 Jung ..... H01J 49/025 250/252.1
7,465,919 B1 12/2008 Hosea et al.
(Continued)

FOREIGN PATENT DOCUMENTS

JP 2000162189 A * 6/2000 ..... G01N 1/2258
JP 2001351565 A * 12/2001
WO WO-2013026063 A1 * 2/2013 ..... H01J 49/0013

OTHER PUBLICATIONS

International Search Report for PCT/JP2017/018454 dated Aug. 1, 2017 [PCT/ISA/210].
(Continued)

*Primary Examiner* — Marcus H Taningco
(74) *Attorney, Agent, or Firm* — Sughrue Mion, PLLC

(57) ABSTRACT

An ion detector (4) includes a shield electrode (42) between an aperture plate (41) and a conversion dynode (43). The shield electrode (42) has a rectilinearly-moving particle block wall (42*a*) positioned on an extension line (C') extending from the central axis (C) of a quadrupole mass filter (3), and an ion attracting electric field adjustment wall (42*b*) inclined by a predetermined angle θ (acute angle) with respect to the extension line (C'). In the ion attracting electric field adjustment wall (42*b*) is provided an ion passing aperture (42*c*). The rectilinearly-moving particles, such as neutral particles, which are ejected from the quadrupole mass filter (3), are blocked by the rectilinearly-moving particle block wall (42*a*), thereby reducing noises caused by the rectilinearly-moving particles. Meanwhile, the potential of the ion attracting electric field adjustment wall (42*b*) corresponds to equipotential surfaces in a strong electric field formed by the conversion dynode (43), and thus the condition of the strong electric field is not remarkably changed from the state where no shield electrode (42) is
(Continued)

provided. Therefore, the effect of drawing ions is exhibited, thereby maintaining the high ion-detection efficiency.

9 Claims, 4 Drawing Sheets

(56) References Cited

U.S. PATENT DOCUMENTS

| | | | | |
|---|---|---|---|---|
| 2002/0162959 | A1* | 11/2002 | Itoi | H01J 49/067 250/292 |
| 2002/0195556 | A1* | 12/2002 | Yoshinari | H01J 49/04 250/283 |
| 2004/0041092 | A1* | 3/2004 | Yamaguchi | H01J 49/025 250/397 |
| 2010/0090102 | A1* | 4/2010 | Rather | H01J 49/062 250/288 |

OTHER PUBLICATIONS

Written Opinion for PCT/JP2017/018454 dated Aug. 1, 2017 [PCT/ISA/237].

* cited by examiner

ION DETECTION DEVICE AND MASS SPECTROMETER

CROSS REFERENCE TO RELATED APPLICATIONS

This application is a National Stage of International Application No. PCT/JP2017/018454, filed on May 17, 2017.

TECHNICAL FIELD

The present invention relates to an ion detection device for detecting ions in a mass spectrometer, and a mass spectrometer using the ion detection device.

BACKGROUND ART

In the field of mass spectrometry, in recent years it has been required that a tiny amount of compound contained in a sample be detected. Thus, the improvement in the sensitivity of mass spectrometers has been an increasingly important mission. In order to address such a mission, the improvement in sensitivity has been approached in an ion source, a mass separator, an ion detector, and such structural elements.

FIG. 9 is a schematic configuration diagram of a typical ion detector in the most-widely used quadrupole mass spectrometer. FIG. 9 also illustrates the simulation results of the trajectories of ions and electrons.

An ion detector 4 mainly includes: an aperture electrode 41 for shielding a quadrupole electric field formed mainly by a quadrupole mass filter 3 at the previous stage; a conversion dynode 43 for converting ions to electrons; and a secondary electron multiplier tube 44 for detecting the electrons with high sensitivity. The aperture electrode 41 is usually maintained at a ground potential (0V), and the conversion dynode 43 is applied with a direct-current (DC) high voltage with the polarity contrary to that of target ions to be analyzed. The applied voltage generates an electrostatic field which efficiently draws, into the conversion dynode 43, ions that have passed through the quadrupole mass filter 3 and reached around an aperture of the aperture electrode 41, and also accelerates the ions. Thus, the ions having large amounts of energy collide with the conversion dynode 43, so that electrons are ejected with high efficiency in the conversion dynode 43. The electrons ejected from the conversion dynode 43 are injected into the secondary electron multiplier tube 44 disposed opposite to the conversion dynode 43 across an extension line C' extending from the central axis (ion optical axis) C of the quadrupole mass filter 3. The secondary electron multiplier tube 44 multiplies the injected electrons, and outputs, as detection signals, current signals corresponding to the amount of electrons.

Neutral particles are not affected by the electric field, and thus move straight in the ion detector 4, after passing through the quadrupole mass filter 3. In mass spectrometers using ion sources by an electron ionization (EI) method or a chemical ionization (CI) method, the neutral particles may be obtained by helium and such a carrier gas, a carrier gas in the metastable state, a compound molecule without being ionized, a reagent gas used in the CI method, and others. In mass spectrometers using ion sources by an electrospray ionization (ESI) method or an atmospheric pressure chemical ionization (APCI) method, the neutral particles may be obtained by droplets (droplets that are not ionized) in which a solvent is not sufficiently vaporized, and so on. In a triple quadrupole mass spectrometer or such mass spectrometers using collision cells, the neutral particles may be obtained by argon, helium, nitrogen, or such a collision gas. Here, the various types of neutral particles which are not intended, may exist in mass spectrometers. In the aforementioned mass spectrometer using the ESI ion source, an electrified droplet in which a solvent is not sufficiently vaporized may be introduced into the quadrupole mass spectrometer 3, instead of the neutral particles. However, the electrified droplet is much heavier than ions, and thus hardly affected by the electric field. Thus, the electrified droplet passes the quadrupole mass spectrometer 3, and then moves straight without receiving any influence, like the neutral particles. Such substances including particles that move straight after passing through the quadrupole mass filter 3 without receiving any influence from the electric field caused by the conversion dynode 43 are referred to as rectilinearly-moving particles, hereinafter.

As described earlier, the rectilinearly-moving particles are not affected at all or are hardly affected by the electric field, and thus do not reach the conversion dynode 43. However, it is known that the rectilinearly-moving particles constitute a factor of noise in detection signals, if the rectilinearly-moving particles move into a strong electric field formed by the conversion dynode 43, or penetrate the flow of electrons moving from the conversion dynode 43 toward the secondary electron multiplier tube 44. Although a mechanism of the noise generation is not fully clarified, the reduction in noise caused by the rectilinearly-moving particles is one of the big issues, for enhancing the sensitivity of ion detectors.

As one of the methods for reducing this type of noise, an ion detector disclosed in Patent Literature 1 has been conventionally known. In the ion detector disclosed in Patent Literature 1, a deflection electrode (it is referred to as "the bending rod" in Patent Literature 1) for deflecting the trajectories of ions from the central axis of a quadrupole mass filter is disposed between an aperture electrode and a conversion dynode so that the central axis of the ion-collision face of the conversion dynode is out of the central axis of the quadrupole mass filter for preventing these axes from crossing each other. The trajectories of ions having passed through the aperture electric field are bent by the effect of the electric field formed by the deflection electrode. The ions then strike the conversion dynode. On the other hand, the rectilinearly-moving particles move substantially straight after passing through the aperture electrode. Thus, the rectilinearly-moving particles move along the course out of the strong electric field formed by the conversion dynode, or out of the flow of electrons moving toward the secondary electron multiplier tube from the conversion dynode.

The conventional ion detector mentioned earlier seems to be effective to prevent the rectilinearly-moving particles from moving into the strong electric field region formed by the conversion dynode and the flow of electrons, and thus seems to be effective for reducing the noise caused by the rectilinearly-moving particles. However, the conversion dynode is located so as to prevent the central axis of its ion-collision face from crossing the central axis of the quadrupole mass filter, thereby failing to adequately exhibit the effect of drawing the ions from the quadrupole mass filter by the strong electric field formed by the conversion dynode. Accordingly, the ratio of ions that reach the conversion dynode among ions that have passed the aperture electrode is lowered. This may lower a level itself of ion-intensity signals. In other words, although the noises caused by the rectilinearly-moving particles are reduced in the conventional ion detector, the level itself of the ion-intensity signals is also lowered. Accordingly, the signal-to-noise (SN) ratio of the detection signals is not necessarily improved.

CITATION LIST

Patent Literature

Patent Literature 1: U.S. Pat. No. 7,465,919 B

SUMMARY OF INVENTION

Technical Problem

The present invention has been made to solve the problems mentioned earlier. An object of the present invention is to provide an ion detection device in which the adequate amount of ions moving into a conversion dynode is secured, and noise caused by rectilinearly-moving particles is reduced, thereby achieving a high SN ratio and high sensitivity, and also to provide a mass spectrometer using the ion detection device.

Solution to Problem

The present invention developed for solving the previously described problem is an ion detection device for detecting: an ion that has passed through an ion separator which separates ions according to the masses or mobilities of the ions; or an ion ejected from the ion separator. The ion detection device includes:

a) a conversion dynode disposed at a position out of an extension line extending from the central axis of a flow of injected ions, for converting, to an electron, the ion drawn by an electric field formed by the conversion dynode itself;

b) an electron detector disposed opposite to the conversion dynode across the extension line of the central axis of the flow of the injected ions, for detecting the electron ejected from the conversion dynode;

c) a shield electrode disposed between the injection position of the flow of the injected ions, and the conversion dynode as well as the electron detector, the shield electrode having:

c1) a block wall disposed on the extension line extending from the central axis of the flow of the injected ions, configured to prevent a particle from passing, and c2) an electric field adjustment wall that extends from the block wall, formed in one of: a flat plane inclined at an acute angle with the central axis towards an ion collision face of the conversion dynode; a curved plane containing a curved line approximating the straight line; and a multi-facet plane approximating the curved plane, and has an aperture or a cut portion configured to allow the ion moving to the conversion dynode to pass through; and d) a voltage applying section configured to apply a predetermined direct-current voltage to the shield electrode.

In the ion detection device according to the present invention, the ion separator is typically a quadrupole mass filter or an ion trap (a three-dimensional quadrupole ion trap or a linear ion trap), as described later.

For example, in the quadrupole mass filter, the central axis of the flow of ions that have passed through the quadrupole mass filter is consistent with the central axis of the quadrupole mass filter. When neutral particles, such as compound molecules, pass through the quadrupole mass filter and are injected in the ion detection device according to the present invention, the neutral particles move substantially straight, since the neutral particles receive no influence from the electric field. Then, the neutral particles collide with the block wall of the shield electrode located in front of the movement course of the neutral particles. When an electrospray ion source is used as the ion source, an electrified droplet may pass through the quadrupole mass filter. Here, the electrified droplet has a large mass, and thus receives little influence from the electric field. Accordingly, the electrified droplet moves substantially straight like neutral particles, and collides with the block wall of the shield electrode. With this configuration, the rectilinearly-moving particles including neutral particles and electrified droplets do not enter a space between the conversion dynode and the electron detector. In other words, the rectilinearly-moving particles neither enter the strong electric field formed by the conversion dynode, nor pass through the flow of electrons moving from the conversion dynode toward the electron detector. Accordingly, noises caused by the rectilinearly-moving particles can be reduced.

Meanwhile, there is the electric field adjustment wall of the shield electrode between the injection position of the flow of the injected ions and the conversion dynode. The electric field adjustment wall as a whole is inclined with respect to the central axis of the flow of ions. Due to the voltage applied from the voltage application section to the shield electrode, the electric field adjustment wall has the predetermined potential. Accordingly, the electric field adjustment wall enables to form a wall having a potential close to the equipotential planes of the electric field formed between the conversion dynode and the injection position of the flow of the injected ions, as in the state where no shield electrode is provided. Therefore, the electric field in a space between the electric field adjustment wall and the injection position of the flow of the injected ions can be approximated to the state where no shield electrode is provided. As a result of the effect of the electric field, ions that have reached the vicinity of the injection position of the flow of the injected ions can be attracted toward the conversion dynode. The attracted ions pass through the aperture or the cut portion of the electric field adjustment wall, and are subsequently accelerated, so as to reach the conversion dynode. In other words, ions can follow the trajectories substantially the same as those in the state where no shield electrode is provided, and can reach the conversion dynode. Therefore, despite the provision of the shield electrode having the function of shielding the rectilinearly-moving particles, the loss of ions due to the shield electrode can be minimized. Thus, the efficiency in detecting ions, which is substantially the same as that obtained in the state where no shield electrode is provided can be achieved.

The ion detection device according to the present invention may further include an aperture electrode configured to shield an electric field caused by the ion separator while allowing the ion to pass through, at the injection position of the flow of the ions ejected from the ion separator. The shield electrode may be disposed between the aperture electrode and the conversion dynode as well as the electron detector.

In the ion separator, such as the quadrupole mass filter and the ion trap, a radio-frequency electric field is used for separating ions in many cases. However, if the radio-frequency electric field intrudes to the area where the ions move in the ion detection device, the trajectories of the ions are affected by the electric field. Meanwhile, if the aperture electrode is provided at the injection position of the flow of ions, i.e., the position outside an ejection port of the ion separator, such as a quadrupole mass filter, so as to substantially shield the radio-frequency electric field of the ion separator, the trajectories of the ions moving towards the conversion dynode are stable, and thus the ions can reach the conversion dynode at high efficiency.

In the ion detection device according to the present invention, it is preferable that the electric field adjustment wall has a wall provided with the aperture through which the ion moving toward the conversion dynode passes.

With this configuration, the electric field of the entire space surrounding the flow of ions that have passed through the aperture of the aperture electrode and move toward the conversion dynode is in the state approximated to the state where no shield electrode is provided. Therefore, the trajectories of ions hardly vary, and thus the configuration is suitable for efficiently increasing the ion detection rate.

In the ion detection device according to the present invention, it is preferable that the aperture provided in the electric field adjustment wall is positioned out of a cylindrical space virtually formed by moving an aperture of the aperture electrode, through which the ion pass, in the direction extending from the central axis of the flow of the injected ions.

As described earlier, the rectilinearly-moving particles that have passed through the quadrupole mass filter substantially move in parallel to the central axis of the quadrupole mass filter, i.e., the central axis of the flow of the injected ions. Accordingly, if the aperture electrode is provided outside the ejection port of the quadrupole mass filter, a spatial (radial) extent of the particle flow of the rectilinearly-moving particles is substantially limited by the size of the aperture of the aperture electrode, through which ions pass. Thus, it can be substantially avoided in the aforementioned configuration that the rectilinearly-moving particles pass through the aperture provided in the electric field adjustment wall. Therefore, noises caused by the rectilinearly-moving particles are assuredly reduced.

In the ion detection device according to the present invention, which has the configuration described earlier, the block wall may be parallel to a plane substantially perpendicular to the central axis of the flow of the injected ions. The shield electrode may have an auxiliary electric field adjustment wall that is parallel to the block wall and extends from the electric field adjustment wall on a side of the electric field adjustment wall opposite to the block wall.

With this configuration, the potential in the position of the auxiliary electric field adjustment wall is fixed, thereby assuredly inhibiting the turbulence in the electric field caused by the installation of the shield electrode.

Although the electric field adjustment wall may be a flat plane, a curved plane, or a multi-facet plane in which a plurality of planes are combined, the curved plane and the multi-facet plane require time for production, causing an increase in cost. In view of the situation, in the ion detection device according to the present invention, the electric field adjustment wall may be a flat plane approximating a curved equipotential plane around a position where the shield electrode is located, in the electrical field formed by the conversion dynode in a state where no shield electrode is provided.

The ion detection device according to the present invention can be used in various types of mass spectrometers.

For example, the mass spectrometer according to the first embodiment of the present invention includes:

the ion detection device according to the present invention;

an ion source configured to ionize a compound in a sample; and a quadrupole mass filter configured to selectively allow an ion having a specified mass-to-charge ratio to pass, among ions generated in the ion source.

In the mass spectrometer, the ion that has passed through the quadrupole mass filter is introduced into the ion detection device so as to be detected.

The mass spectrometer according to the first embodiment of the present invention is a single quadrupole mass spectrometer. Depending on whether the sample is a liquid sample or a gas sample (a sample gas), an appropriate ionization method is properly used.

The mass spectrometer according to the second embodiment of the present invention includes:

the ion detection device according to the present invention;

an ion source configured to ionize a compound in a sample;

a previous-stage quadrupole mass filter configured to selectively allow an ion having a specified mass-to-charge ratio to pass, among ions generated in the ion source;

an ion dissociation section configured to dissociate the ion that has passed through the previous-stage quadrupole mass filter; and a later-stage quadrupole mass filter configured to selectively allow an ion having a specified mass-to-charge ratio to pass, among product ions generated by dissociation in the ion dissociation section.

In the mass spectrometer, the ion that has passed through the later-stage quadrupole mass filter is introduced into the ion detection device so as to be detected.

As the ion dissociation section, a collision cell in which ions are dissociated by a collision-induced dissociation (CID) can be used, for example. The mass spectrometer according to the second embodiment is a triple quadrupole mass spectrometer.

The mass spectrometer according to the third embodiment of the present invention includes:

the ion detection device according to the present invention;

an ion source configured to ionize a compound in a sample; and an ion trap configured to: first trap ions generated in the ion source or other ions derived from the ions generated in the ion source; separate the ions according to the mass-to-charge ratios of the ions; and sequentially eject the ions.

In the mass spectrometer, the ions ejected from the ion trap are introduced into the ion detection device so as to be detected.

The mass spectrometer according to the third embodiment is an ion trap mass spectrometer. The ion trap may be either a three-dimensional quadrupole ion trap or a linear ion trap.

Advantageous Effects of Invention

In the ion detection device according to the present invention, the drawing effect of ions by a strong electric field formed by the voltage applied to a conversion dynode is effectively used, thereby securing the adequate amount of ions to be incident on the conversion dynode. In addition, the noises caused by particles which receive no or little influence from the electric field and thus move straight can be reduced. In the ion detection device and the mass spectrometer, according to the present invention, the higher SN ratio and higher detection sensitivity than those of a conventional ion detection device and a mass spectrometer using the conventional ion detection device can be achieved.

DESCRIPTION OF EMBODIMENTS

The mass spectrometer including the ion detector according to an embodiment of the present invention is described, with reference to the drawings.

Figure 1:
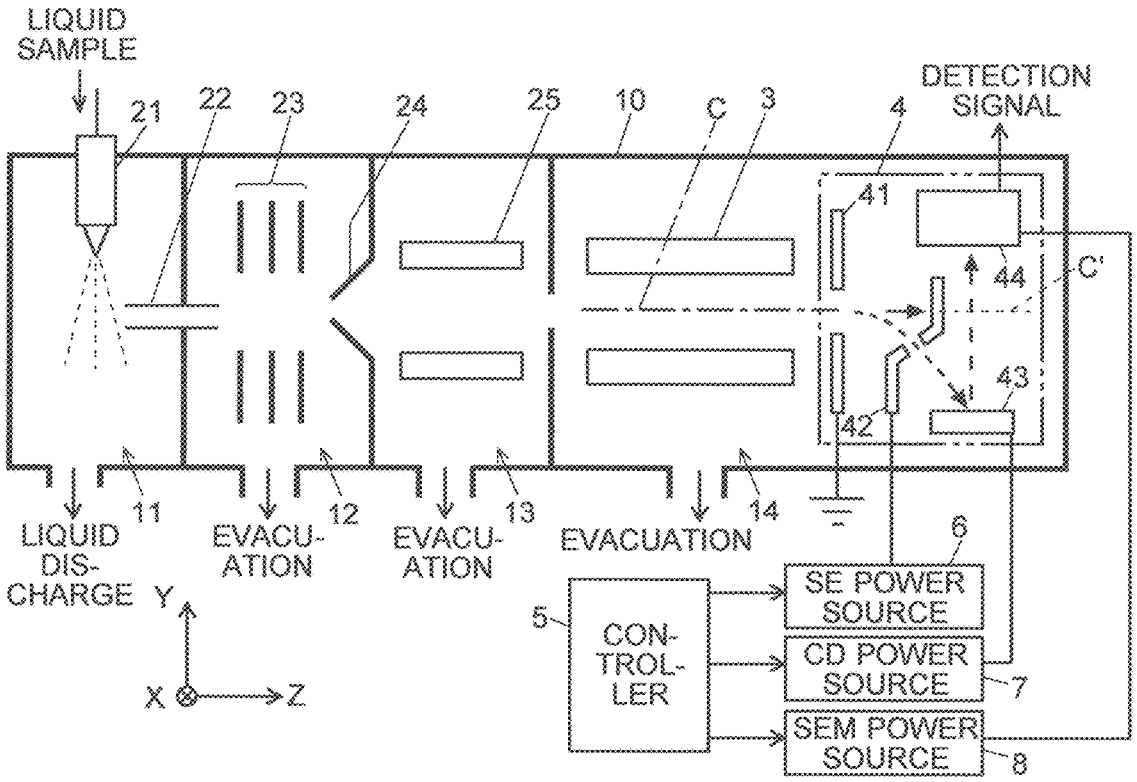
FIG. 1 is a schematic diagram showing the entire configuration of a mass spectrometer including an ion detector according to an embodiment of the present invention.
Figure 2:
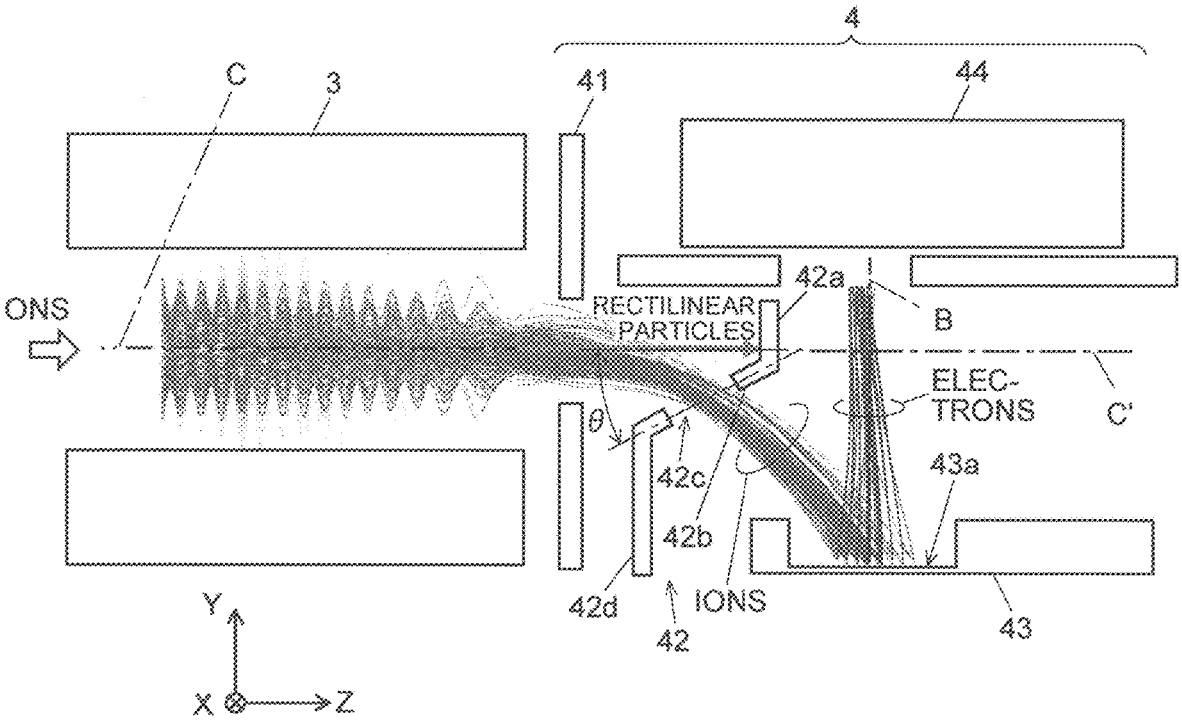
FIG. 2 illustrates simulation results of the trajectories of ions in the ion detector according to the present embodiment.
Figure 3:
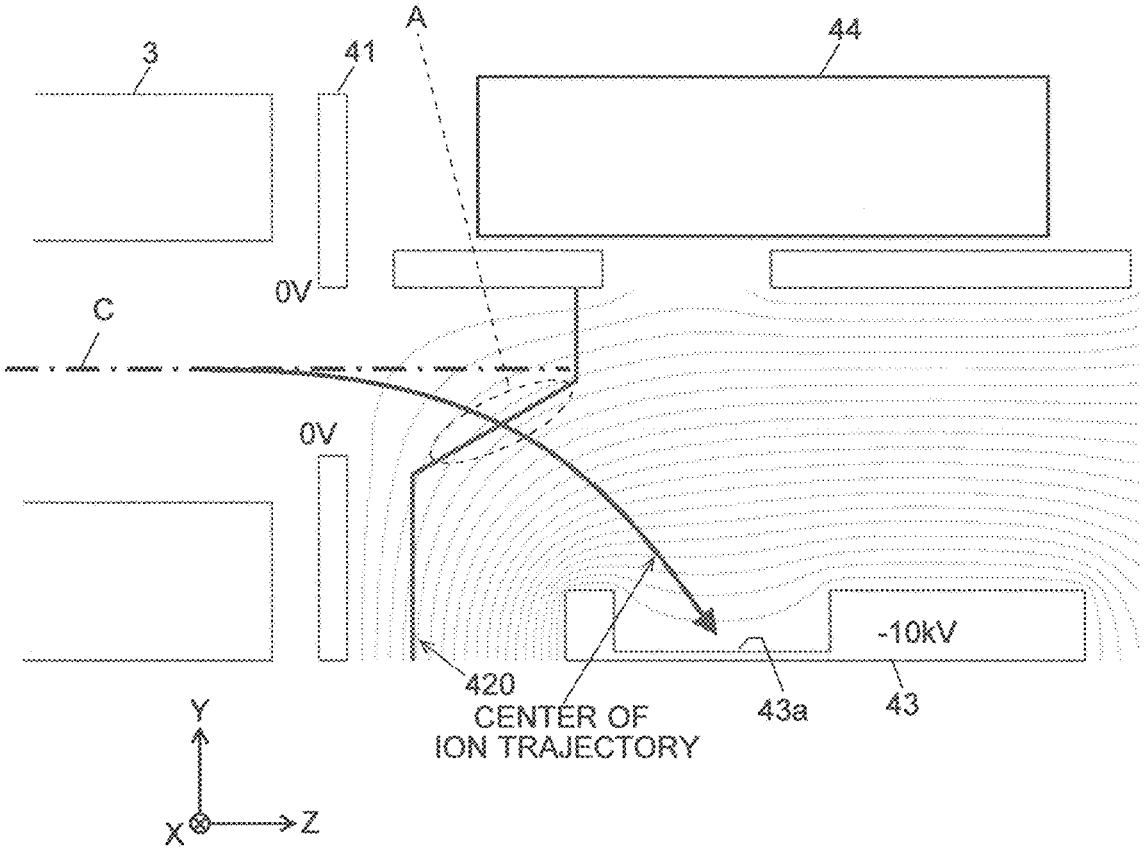
FIG. 3 is an explanatory diagram showing how to define the shape of a shield electrode based on the simulation results of equipotential planes in an electric field formed by the conversion dynode in the ion detector according to the present embodiment.
Figure 4:
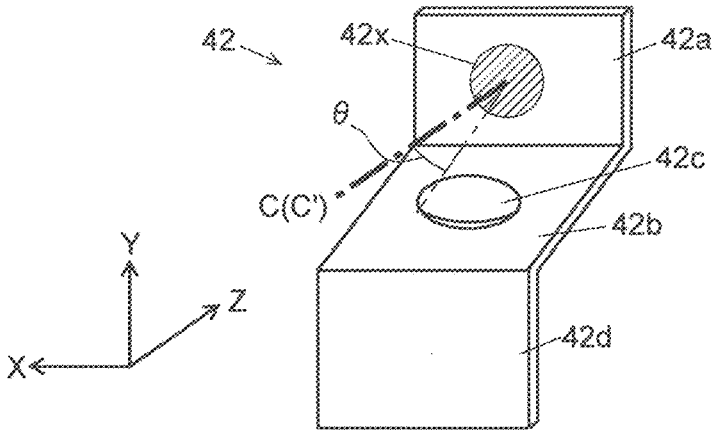
FIG. 4 is a perspective view of the exterior of the shield electrode in the ion detector according to the present embodiment.

FIG. 1 is a schematic diagram of the entire configuration of the mass spectrometer. FIG. 2 illustrates simulation results of the trajectories of ions in an ion detector 4 shown in FIG. 1. FIG. 3 is an explanatory diagram showing how to define the shape of a shield electrode based on the simulation results of the equipotential planes in an electric field formed by a conversion dynode in the ion detector 4. FIG. 4 is a perspective view of the exterior of a shield electrode 42 in the ion detector 4. The mass spectrometer performs mass spectrometry by ionizing compounds contained in a liquid sample, and a liquid chromatograph is typically connected in the previous stage of the mass spectrometer.

As shown in FIG. 1, an ionization chamber 11, a first intermediate vacuum chamber 12, a second intermediate vacuum chamber 13, and a high vacuum chamber 14 are provided in a chamber 10. The ionization chamber 11 is kept, in its interior, at approximate atmospheric-pressure. The degree of vacuum increases in a stepwise manner from the ionization chamber 11 to the high vacuum chamber 14, as a multistage differential discharge system. A liquid sample is sprayed from an electrospray ionization nozzle 21 to the interior of the ionization chamber 11. Compounds in electrified droplets generated by the spray are ionized during the process in which the droplets are broken up and a solvent is evaporated. The various ions that are generated are sent to the first intermediate vacuum chamber 12 via a heated capillary 22, converged by an ion guide 23, and then sent to the second intermediate vacuum chamber 13 through a skimmer 24. The ions are converged by an ion guide 25, and sent to the high vacuum chamber 14, so as to be introduced into the quadrupole mass filter 3.

The predetermined voltage (the voltage obtained by totaling a direct-current voltage with a radio-frequency voltage) is applied to four rod electrodes that constitute the quadrupole mass filter 3. Only ions having the mass-to-charge ratio corresponding to the applied voltage pass through the quadrupole mass filter 3, and are introduced into the ion detector 4. The ion detector 4 creates detection signals according to the amount of the introduced ions. Here, the central axis C of the quadrupole mass filter 3 is the optical axis (central axis) of the flow of ions that pass through the quadrupole mass filter 3.

The ion detector 4 includes an aperture electrode 41, a shield electrode 42, a conversion dynode 43, and a secondary electron multiplier tube 44. The aperture electrode 41 is located in the very vicinity of an ejection port of the quadrupole mass filter 3, has substantially a disc shape, and is provided with a circular aperture having its center on the central axis C of the quadrupole mass filter 3. The conversion dynode 43 has a substantially disc-shaped ion collision face 43*a*, and is located so that the central axis B of the ion collision face 43*a* is substantially perpendicular to an extension line C' extending from the central axis C of the quadrupole mass filter 3. The secondary electron multiplier tube 44 is disposed at a position substantially opposite to the ion collision face 43*a* of the conversion dynode 43 across the extension line C' extending from the central axis C of quadrupole mass filter 3.

The aperture electrode 41 is grounded, and the predetermined direct-current voltage is applied to each of the shield electrode 42, the conversion dynode 43, and the secondary electron multiplier tube 44, from an SE power source 6, a CD power source 7, and an SEM power source 8. These voltages are controlled by a controller 5. Although it is natural that the predetermined voltage is also applied to each of the quadrupole mass filter 3, and the ion guides 23 and 25, the description of circuit blocks for applying the voltage to the respective structural elements other than the ion detector 4 is omitted.

For the convenience of the description, a direction extending from the central axis C of the quadrupole mass filter 3 (the horizontal direction in FIGS. 1 to 3) is set to the Z direction; a direction orthogonal to the Z direction and extending from the central axis of the ion collision face 43*a* of the conversion dynode 43 (the vertical direction in FIGS. 1 to 3) is set to the Y direction, and a direction orthogonal to the Z direction as well as the Y direction is set to the X direction (the direction perpendicular to the drawing sheet).

Figure 8:
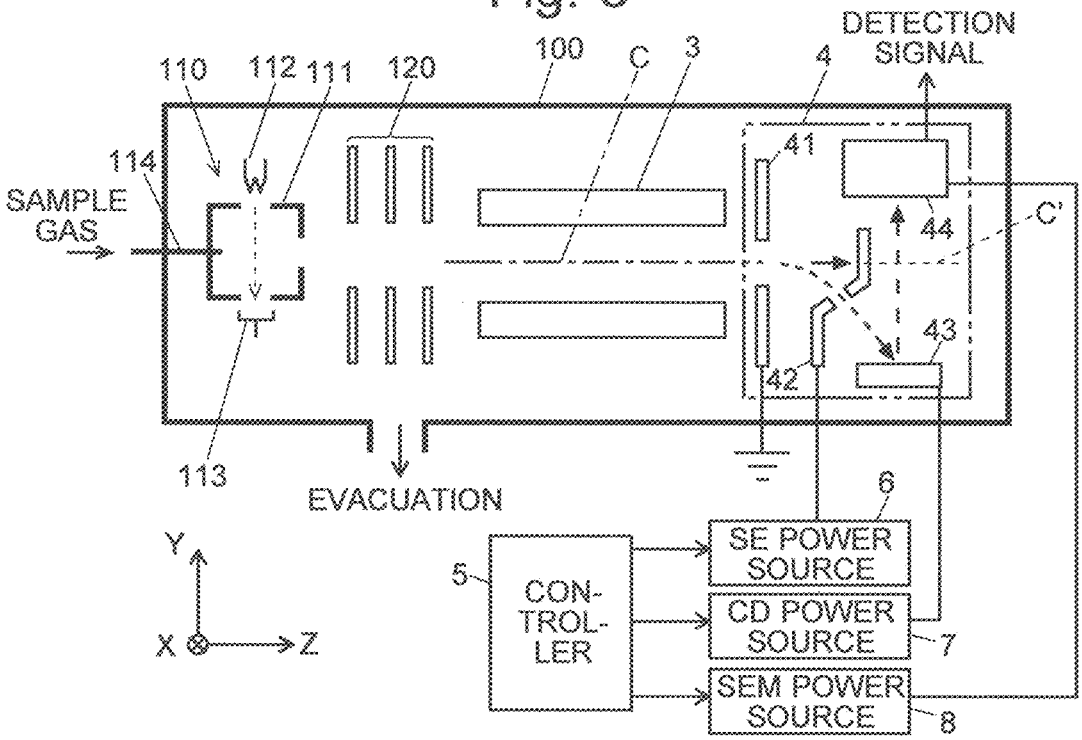
FIG. 8 is a schematic diagram showing the entire configuration of another example of the mass spectrometer including the ion detector according to the embodiment of the present invention.
Figure 9:
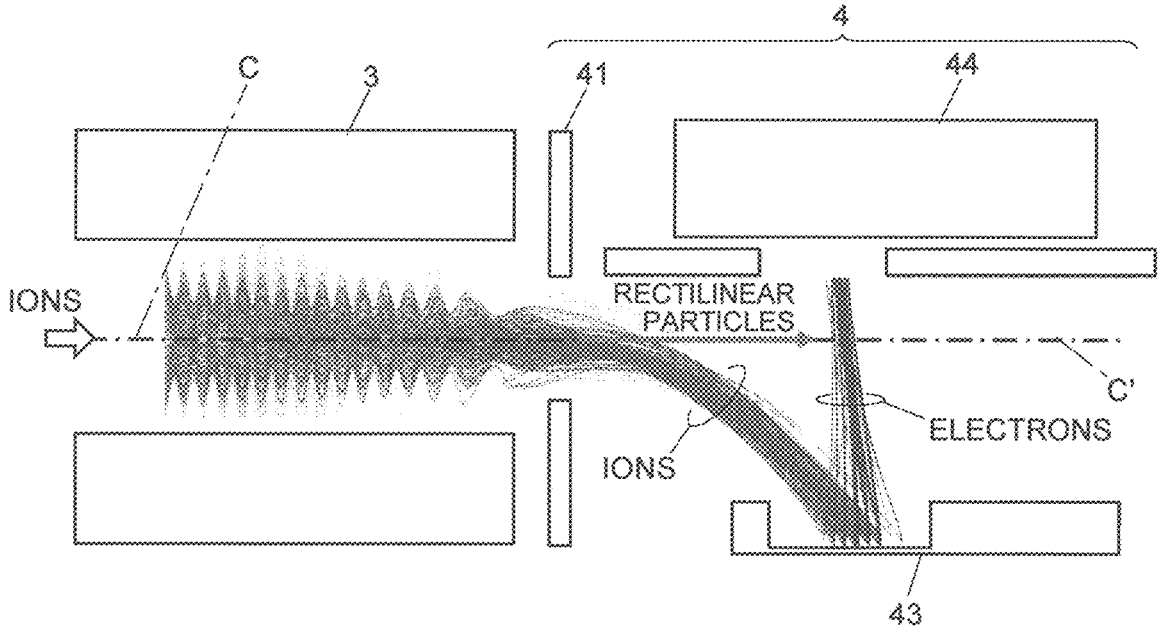
FIG. 9 is a schematic configuration diagram of an ion detector in a conventional quadrupole mass spectrometer.

In the ion detector 4, the aperture electrode 41, the conversion dynode 43, and the secondary electron multiplier tube 44 are basically the same as those of conventional ion detectors as shown in FIG. 8. The distinguishing structural element of the ion detector 4 is the shield electrode 42 disposed between the aperture electrode 41 and the conversion dynode 43.

As shown in FIG. 4, the shield electrode 42 is formed, for example, by bending a single metallic plate member (or an electrically conductive plate member other than the metallic plate member) at two lines both extending in the X direction, and includes a rectilinearly-moving particle block wall 42*a*, an ion attracting electric field adjustment wall 42*b*, and an auxiliary electric field adjustment wall 42*d*, all of which extend in this order. The rectilinearly-moving particle block wall 42*a* and the auxiliary electric field adjustment wall 42*d* both are parallel to the X-Y plane. The ion attracting electric field adjustment wall 42*b* is inclined by the predetermined angle θ (here, θ is an acute angle) with respect to the X-Z plane. The plane includes a straight line perpendicular to the rectilinearly-moving particle block wall 42*a* (in FIG. 4, the straight line corresponds to the central axis C of the ion flow or the extension line C' extending from the central axis C). A circular-shaped ion passing aperture 42*c* is drilled at the predetermined position of the ion attracting electric field adjustment wall 42*d*.

As shown in FIGS. 1 to 3, the shield electrode 42 having such a shape is disposed in such a manner that: the rectilinearly-moving particle block wall 42*a* is orthogonal to the central axis C of the quadrupole mass filter 3; the auxiliary electric field adjustment wall 42*d* is closer to the aperture electrode 41 than the rectilinearly-moving particle block wall 42*a* is; and the auxiliary electric field adjustment wall 42*d* is located between the aperture electrode 41 and the conversion dynode 43. Hereinafter, the description is given to the way of determining the inclination angle θ of the ion attracting electric field adjustment wall 42*b* and the voltage to be applied to the shield electrode 42.

FIG. 3 shows that equipotential planes of the electric field (strictly, the equipotential lines at the section including the central axis C) which is formed by a voltage (here, the voltage is −10 kV) applied to the conversion dynode 43, when no shield electrode 42 is provided. The equipotential lines between the conversion dynode 43 and the aperture electrode 41 have the curved shape as shown in FIG. 3. The trajectories of ions which are ejected from the quadrupole mass filter 3 and move in the Z direction, are gradually bent due to the potential gradient in accordance with the equipotential planes, so that the ions reach the ion collision face 43*a* of the conversion dynode 43.

In order to keep the efficiency in detecting ions when the shield electrode 42 is provided between the aperture electrode 41 and the conversion dynode 43, it is preferable that the trajectories of the ions from the quadrupole mass filter 3 to the conversion dynode 43 are changed as little as possible from the state where no shield electrode 42 is provided. In view of this, it is preferable that the electric field in the ion-passing region, i.e., the condition of the equipotential planes, changes as little as possible. Accordingly, the curved equipotential lines in the electric field near the ion-passing region, as shown in FIG. 3, are approximated to a straight line, so as to determine the inclination angle θ of the ion attracting electric field adjustment wall 42*b* of the shield electrode 42 based on the angle of the straight line obtained by the approximation with respect to the central axis C.

In the example shown in FIG. 3, the shape of the shield electrode, which is indicated by the reference numeral 420 in FIG. 3, is calculated based on the straight line obtained by the approximation of the equipotential lines in the region indicated by the reference sign A in FIG. 3. A voltage to be applied to the shield electrode 42 is determined from the potential of the equipotential lines around the intersection of the center of the ion trajectories and the ion attracting electric field adjustment wall 42*b* of the shield electrode 42. Here, even if the equipotential planes are calculated by the simulation as shown in FIG. 3, discrepancy is unavoidable in equipotential planes in an actual apparatus. Furthermore, there are ions and rectilinearly-moving particles which do not show the ideal action. In addition, the actions of ions are slightly different from one another depending on the mass-to-charge ratio of ions to be observed. Accordingly, it is preferable to find the optimal state by adjusting the shape of the shield electrode and the voltage to be applied, for obtaining the highest efficiency in detecting ions.

FIG. 2 shows the simulation result of the trajectories of ions and electrons. As seen from FIG. 2, ions that have passed through the aperture electrode 41 pass through the ion passing aperture 42*c* almost without colliding with the ion attracting electric field adjustment wall 42*b* of the shield electrode 42. In contrast, most of the rectilinearly-moving particles, such as neutral particles, collide with the rectilinearly-moving particle block wall 42*a* and rebound, so as to be discharged to the outside by the evacuation. Accordingly, few rectilinearly-moving particles enter a space between the conversion dynode 43 and the secondary electron multiplier tube 44, thereby significantly inhibiting noises caused by the rectilinearly-moving particles. Meanwhile, ions receive little influence caused by the shield electrode 42, thereby achieving high efficiency in the detection of ions.

Figure 5A:
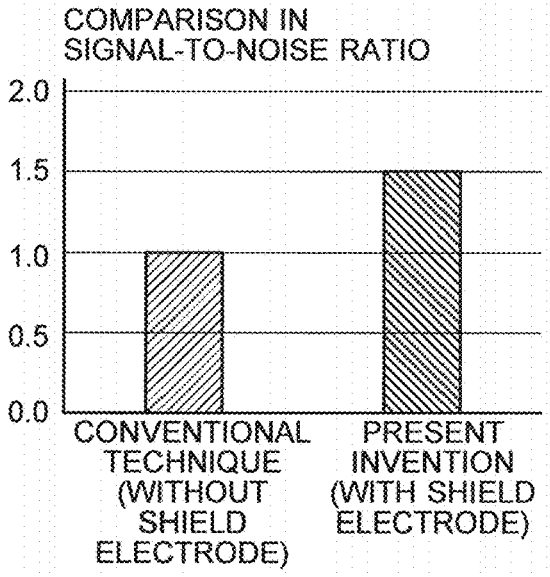
FIGS. 5A and 5B are graphs respectively showing the effect of improvement in the SN ratio and the effect of reduction in a noise level in the ion detector according to the present embodiment.
Figure 5B:
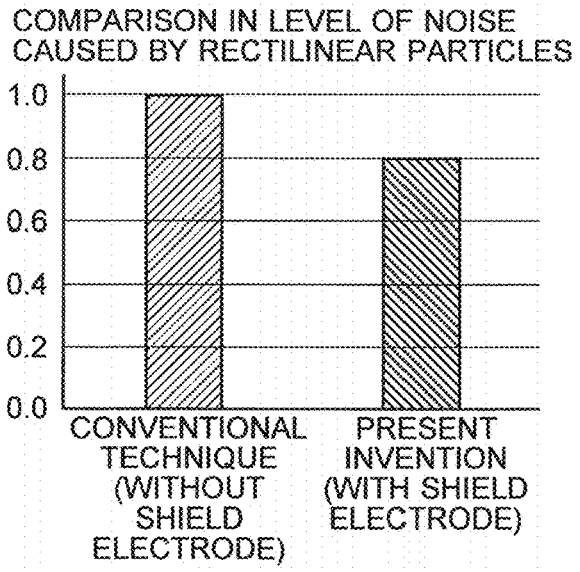

FIG. 5 shows the results of experimental search on the SN ratio and the level of noises caused by the rectilinearly-moving particles, under the conditions with and without the shield electrode. As seen from the results, if the aforementioned shield electrode is provided, the rectilinearly-moving particles are blocked, thereby lowering the level of noise caused by the rectilinearly-moving particles, as well as improving the SN ratio. Thus, the effectiveness of the shield electrode is confirmed.

Figure 6:
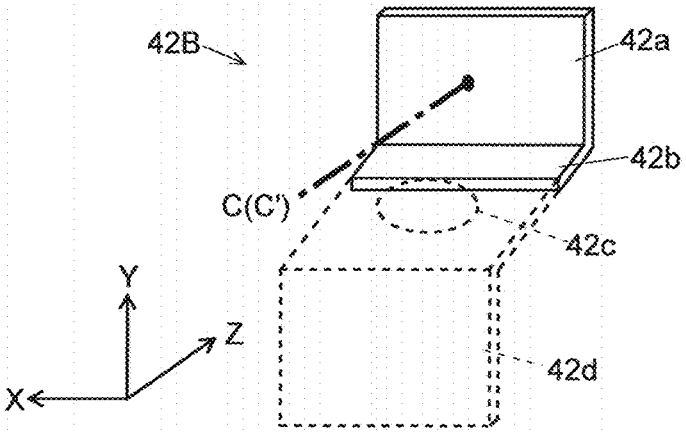
FIG. 6 is a perspective view of the exterior of a modified example of the shield electrode.

The shape of the shield electrode is not limited to the one shown in FIG. 4. What is important is to block the rectilinearly-moving particles, and to prevent the significant change in the state of the electric field between the aperture electrode 41 and the conversion dynode 43, from the state where no shield electrode is provided. For the former one, the rectilinearly-moving particle block wall 42*a* is necessary. For the latter one, the ion attracting electric field adjustment wall 42*b* extending from the rectilinearly-moving particle block wall 42*a* is necessary. Here, the ion attracting electric field adjustment wall 42*b* may have a short length. For example, as shown in FIG. 6, the ion attracting electric field adjustment wall 42*b* may have a short length up to a position where the ion passing aperture 42*c* is provided in the shield electrode 42, as shown in FIG. 4.

Figure 7A:
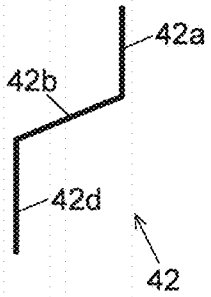
FIGS. 7A to 7D are schematic plan views showing another modified example of the shield electrode.
Figure 7B:
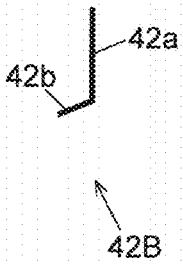
Figure 7C:
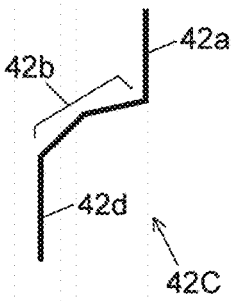
Figure 7D:
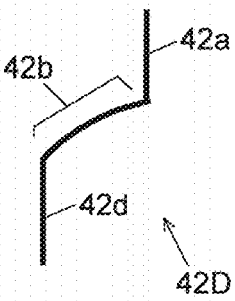
Figure 7D:
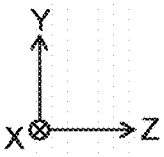

FIGS. 7A to 7D show examples of the shield electrode in different shapes. FIGS. 7A to 7D are side views of shield electrodes. FIG. 7A is the shield electrode 42 shown in FIG. 4, and FIG. 7B is the shield electrode 42B shown in FIG. 6. In these shield electrodes 42 and 42B, the ion attracting electric field adjustment wall 42*b* has the planar shape. Meanwhile, in a shield electrode 42C shown in FIG. 7C, the ion attracting electric field adjustment wall 42*b* is bent at its midway portion. In a shield electrode 42D shown in FIG. 7D, the ion attracting electric field adjustment wall 42*b* is shaped in a curved face. It is apparent that these configurations can also provide the same effects as those provided by the ion detector 4 in the previous embodiment.

Furthermore, the rectilinearly-moving particle block wall 42*a* may not be completely orthogonal to the extension line C' extending from the central axis C of the quadrupole mass filter 3. The same is applied to the auxiliary electric field adjustment wall 42*d*.

Next, the description is given to the case where the ion detector 4 in the aforementioned embodiment is used in a mass spectrometer in which compounds in a sample gas are ionized to be subjected to mass spectrometry. FIG. 8 is a schematic diagram of the entire configuration of such a mass spectrometer, and structural elements which are the same as or correspond to those in the mass spectrometer in FIG. 1 are allocated with the same reference signs, and the detailed description of these elements is omitted. A gas chromatograph is often connected to the mass spectrometer in the previous stage.

In the mass spectrometer, an ion source 110, a lens electrode 120, the quadrupole mass spectrometer 3, and the ion detector 4 are provided inside a chamber 100 that is evacuated by a vacuum pump (not shown). Here, the ion source 110 is prepared by the EI method, and includes an ionization chamber 111, a filament 112 for generating thermal electrons, a trap electrode 113 for trapping the thermal electrons, and a sample-gas introduction tube 114 for introducing sample gas into the ionization chamber 111. In addition, a repeller electrode is provided inside the ionization chamber 111 (not shown).

The sample gas is introduced into the ionization chamber 111 through the sample gas introduction tube 114, and compounds in the sample gas are ionized by being in contact with the thermal electrons that are generated by the filament 112 and move toward the trap electrode 113. The generated ions are pushed out of the ionization chamber 111 by the electric field formed by the repeller electrode, or drawn out of the ionization chamber 111 by the electric field formed by the lens electrode 120, so as to be introduced into the quadrupole mass filter 3, while being converged by the lens electrode 120. The actions of the ions after being introduced into the quadrupole mass filter 3 are the same as those described with reference FIGS. 1 to 4. In this mass spectrometer, the majority of the sample gas is a carrier gas to be used in the gas chromatograph in the previous stage. The molecules of the carrier gas or metastable molecules that are meta-stabled carrier-gas molecules are easily introduced, as neutral particles, into the quadrupole mass spectrometer 3. The rectilinearly-moving particles, which are such neutral particles, are blocked by the rectilinearly-moving particle block wall 42*a* of the shield electrode 42, as mentioned earlier, so as to be prevented from being the noise source.

When the ion source prepared by the CI method, as opposed to the EI method, is used as the ion source 110, a reagent gas for the ionization is introduced into the ionization chamber, and this reagent gas also becomes the rectilinearly-moving particles. Such rectilinearly-moving particles that are neutral particles are also blocked by the rectilinearly-moving particle block wall 42*a* of the shield electrode 42, as mentioned earlier, so as to be prevented from being the noise source.

Although the mass spectrometers shown in FIGS. 1 and 8 each are a single quadrupole mass spectrometer, the ion detector 4 in the embodiment may be used as an ion detector of a triple quadrupole mass spectrometer. In addition, the ion detector 4 can also be used in an ion trap mass spectrometer. In such a case, the ion trap mass spectrometer is either a linear mass spectrometer or a three-dimensional quadrupole mass spectrometer. It is only required that the ion detector 4 be disposed so that the aperture electrode 41 is located at the outside of an ion ejection port from which ions are ejected from the ion trap.

In the embodiment described earlier, the aperture electrode 41 is not necessarily provided in the ion detector 4. However, if the aperture electrode 41 is not provided, it is necessary for the ion detector 4 to be disposed away from the quadrupole mass filter 3 (or the ion trap). In such a configuration, however, the loss of the ions sent from the quadrupole mass filter 3 increases, causing the disadvantage of the efficiency in the ion detection. Accordingly, it is preferable that the aperture electrode 41 be practically provided, though it is not indispensable.

The aforementioned embodiment and various modified embodiments of the embodiment are an example of the present invention. It is apparent that any modification, correction, or addition within the concept of the present invention is included in the scope of claims of the present application.

REFERENCE SIGNS LIST

10 . . . Chamber
11 . . . Ionization Chamber
12 . . . First Intermediate Vacuum Chamber
13 . . . Second Intermediate Vacuum Chamber
14 . . . High Vacuum Chamber
21 . . . Electrospray Ionization Nozzle
22 . . . Heated Capillary
23, 25 . . . Ion Guide
24 . . . Skimmer
3 . . . Quadrupole Mass Filter
4 . . . Ion Detector
41 . . . Aperture Electrode
42, 42*b*, 42*c*, 42*d* . . . Shield Electrode
42*a* . . . Rectilinearly-Moving Particle Block Wall
42*b* . . . Ion Attracting Electric Field Adjustment Wall
42*c* . . . Ion Passing Aperture
42*d* . . . Auxiliary Electric Field Adjustment Wall
43 . . . Conversion Dynode
43*a* . . . Ion Collision Face
44 . . . Secondary Electron Multiplier Tube
5 . . . Controller
6 . . . SE Power Source
7 . . . CD Power Source
8 . . . SEM Power Source
110 . . . Ion Source
111 . . . Ionization Chamber
112 . . . Filament
113 . . . Trap Electrode
114 . . . Sample Gas Introduction Tube
120 . . . Lens Electrode

The invention claimed is:

1. An ion detection device for detecting: an ion that has passed through an ion separator which separates ions according to masses or mobilities of the ions; or an ion ejected from the ion separator, the ion detection device comprising:

a) a conversion dynode disposed at a position out of an extension line extending from a central axis of a flow of injected ions, for converting, to an electron, the ion drawn by an electric field formed by the conversion dynode itself;

b) an electron detector disposed opposite to the conversion dynode across the extension line of the central axis of the flow of the injected ions, for detecting the electron ejected from the conversion dynode;

c) a shield electrode disposed between an injection position of the flow of the injected ions, and the conversion dynode as well as the electron detector, the shield electrode having:

c1) a block wall disposed on the extension line extending from the central axis of the flow of the injected ions, configured to prevent a particle from passing, and c2) an electric field adjustment wall that extends from the block wall, formed in one of: a flat plane inclined at an acute angle with the central axis towards an ion collision face of the conversion dynode; a curved plane containing a curved line approximating the curved plane, and a multi-facet plane approximating the curved plane, and has an aperture or a cut portion configured to allow the ion moving to the conversion dynode to pass through; and d) a voltage applying section configured to apply a predetermined direct-current voltage to the shield electrode.

2. The ion detection device according to claim 1, further comprising an aperture electrode configured to shield an electric field caused by the ion separator while allowing the ion to pass through, at the injection position of the flow of the ions ejected from the ion separator, wherein the shield electrode is disposed between the aperture electrode and the conversion dynode as well as the electron detector.

3. The ion detection device according to claim 2, wherein the electric field adjustment wall has a wall provided with the aperture through which the ion moving toward the conversion dynode passes.

4. The ion detection device according to claim 3, wherein the aperture provided in the electric field adjustment wall is positioned out of a cylindrical space virtually formed by moving an aperture of the aperture electrode, through which the ion pass, in a direction extending from the central axis of the flow of the injected ions.

5. The ion detection device according to claim 3, wherein the block wall is parallel to a plane substantially perpendicular to the central axis of the flow of the injected ions, and the shield electrode has an auxiliary electric field adjustment wall that is parallel to the block wall and extends from the electric field adjustment wall on a side of the electric field adjustment wall opposite to the block wall.

6. The ion detection device according to claim 1, wherein the electric field adjustment wall is a flat plane approximating a curved equipotential plane around a position where the shield electrode is located, in the electrical field formed by the conversion dynode in a state where no shield electrode is provided.

7. A mass spectrometer comprising:

the ion detection device according to claim 1, an ion source configured to ionize a compound in a sample; and a quadrupole mass filter configured to selectively allow an ion having a specified mass-to-charge ratio to pass, among ions generated in the ion source, wherein the ion that has passed through the quadrupole mass filter is introduced in the ion detection device so as to be detected.

8. A mass spectrometer comprising:

the ion detection device according to claim 1, an ion source configured to ionize a compound in a sample;

a previous-stage quadrupole mass filter configured to selectively allow an ion having a specified mass-to-charge ratio to pass, among ions generated in the ion source;

an ion dissociation section configured to dissociate the ion that has passed through the previous-stage quadrupole mass filter; and a later-stage quadrupole mass filter configured to selectively allow an ion having a specified mass-to-charge ratio to pass, among product ions generated by dissociation in the ion dissociation section, wherein the ion that has passed through the later-stage quadrupole mass filter is introduced in the ion detection device so as to be detected.

9. A mass spectrometer comprising:

the ion detection device according to claim 1, an ion source configured to ionize a compound in a sample; and an ion trap configured to: first trap ions generated in the ion source or other ions derived from the ions generated in the ion source; separate the ions according to mass-to-charge ratios of the ions; and sequentially eject the ions, wherein the ions ejected from the ion trap are introduced in the ion detection device so as to be detected.

* * * * *